US012188178B2

(12) United States Patent
Quigley

(10) Patent No.: US 12,188,178 B2
(45) Date of Patent: Jan. 7, 2025

(54) STRUCTURED FABRIC WITH DISCRETE ELEMENTS

(71) Applicant: Voith Patent GmbH, Heidenheim (DE)

(72) Inventor: Scott D. Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 37 days.

(21) Appl. No.: 18/076,506

(22) Filed: Dec. 7, 2022

(65) Prior Publication Data

US 2024/0191431 A1 Jun. 13, 2024

(51) Int. Cl.

| | |
|---|---|
| ***D21F 1/12*** | (2006.01) |
| ***D21F 1/00*** | (2006.01) |
| ***D21F 11/00*** | (2006.01) |
| *D21F 7/12* | (2006.01) |

(52) U.S. Cl.
CPC ..... *D21F 1/0027* (2013.01); *D21F 11/006* (2013.01)

(58) Field of Classification Search
CPC ..... D21F 1/0027; D21F 11/006
See application file for complete search history.

(56) References Cited

U.S. PATENT DOCUMENTS 4,182,381 A * 1/1980 Gisbourne ..... D21F 1/0036 162/903
4,231,401 A * 11/1980 Matuska ..... D21F 1/0027 162/903
4,281,688 A * 8/1981 Kelly ..... D21F 1/0027 162/903
4,460,023 A * 7/1984 Mullaney ..... D21F 1/0036 162/902
4,771,814 A * 9/1988 Quigley ..... D21F 1/0054 162/348
4,789,009 A * 12/1988 Troughton ..... D21F 1/0036 162/903
4,989,647 A * 2/1991 Marchand ..... D21F 1/0036 139/383 A
5,067,526 A * 11/1991 Herring ..... D21F 1/0036 162/903
5,101,866 A * 4/1992 Quigley ..... D21F 1/0036 139/413
5,103,874 A * 4/1992 Lee ..... D21F 1/0054 139/383 A
5,188,884 A * 2/1993 Smith ..... D21F 1/0054 162/902

(Continued)

*Primary Examiner* — Robert H Muromoto, Jr.
(74) *Attorney, Agent, or Firm* — Laurence A. Greenberg; Werner H. Stemer; Ralph E. Locher

(57) ABSTRACT

A woven fabric for a fiber web producing machine has a defined machine direction, a cross machine direction, a web facing side, and a machine side. The web facing side is formed by MD yarns that extend substantially in the machine direction and by CD yarns extending substantially in the cross machine direction of the woven fabric. The MD yarns and CD yarns are interwoven with each other and the woven fabric is configured to structure the fiber web produced on the woven fabric. A plurality of adjacent long flotations of MD yarns on the web facing side form together a discrete element that is raised on the web facing side for allowing the woven fabric to structure the fiber web. The term "long flotation" means that the MD yarn passes over at least six adjacent CD yarns on the web facing side of the woven fabric.

17 Claims, 10 Drawing Sheets

(56) References Cited

U.S. PATENT DOCUMENTS 5,230,371 A * 7/1993 Lee ..... D21F 1/0054 442/213
5,244,543 A * 9/1993 Fry ..... D03D 15/46 139/420 R
5,465,764 A * 11/1995 Eschmann ..... D21F 1/0036 139/425 A
5,544,678 A * 8/1996 Barrett ..... D21F 1/0045 139/383 A
5,555,917 A * 9/1996 Quigley ..... D21F 1/0036 139/383 A
5,694,980 A * 12/1997 Quigley ..... D21F 1/0036 139/383 A
5,713,397 A * 2/1998 Quigley ..... D21F 11/006 139/383 A
5,799,707 A * 9/1998 Barrett ..... D21F 1/0027 139/383 A
5,806,569 A * 9/1998 Gulya ..... D03D 15/43 162/902
5,853,547 A * 12/1998 Ahrens ..... D21F 1/0027 162/903
5,887,630 A * 3/1999 Shipley ..... D21F 7/083 442/270
5,899,240 A * 5/1999 Wilson ..... D21F 1/0045 139/383 A
5,975,149 A * 11/1999 Lee ..... D21F 1/0036 162/902
6,123,116 A * 9/2000 Ward ..... D21F 1/0045 162/903
6,148,869 A * 11/2000 Quigley ..... D21F 1/0036 139/383 A
6,179,013 B1 * 1/2001 Gulya ..... D21F 1/0045 139/383 A
6,227,256 B1 * 5/2001 Quigley ..... D21F 1/0036 139/383 A
6,253,796 B1 * 7/2001 Wilson ..... D21F 1/0045 139/383 A
6,276,402 B1 * 8/2001 Herring ..... D21F 1/0045 162/903
6,379,506 B1 * 4/2002 Wilson ..... D21F 1/0045 442/205
6,413,377 B1 * 7/2002 Wright ..... D21F 1/0036 162/903
6,708,732 B1 * 3/2004 Hay ..... D21F 11/145 162/902
6,810,917 B2 * 11/2004 Stone ..... D21F 1/0036 162/903
6,837,275 B2 * 1/2005 Josef ..... D21F 1/0036 139/426 R
6,837,276 B2 * 1/2005 Josef ..... D21F 1/0036 139/426 R
7,048,012 B2 * 5/2006 Martin ..... D21F 1/0045 139/408
7,059,359 B2 * 6/2006 Quigley ..... D21F 1/0045 162/348
7,093,621 B2 * 8/2006 Canon ..... D03D 3/04 139/383 A
7,114,529 B2 * 10/2006 Johnson ..... D21F 5/18 442/205
7,198,067 B2 * 4/2007 Collegnon ..... D21F 1/0045 139/408
7,360,560 B2 * 4/2008 Barrett ..... D21F 1/0027 139/383 R
7,484,538 B2 * 2/2009 Barratte ..... D21F 1/0045 162/902
7,530,996 B2 * 5/2009 Bentele ..... D03D 15/41 623/23.74
7,644,738 B2 * 1/2010 Kroll ..... D21F 1/0027 139/383 R
7,766,053 B2 * 8/2010 Barratte ..... D21F 1/0036 139/383 R
7,879,193 B2 * 2/2011 Quigley ..... D21F 11/006 162/903
7,879,194 B2 * 2/2011 Quigley ..... D21F 11/006 162/903
7,879,195 B2 * 2/2011 Quigley ..... D21F 11/006 162/903
7,993,493 B2 * 8/2011 Quigley ..... D21F 1/0027 162/903
8,267,125 B2 * 9/2012 Pitzler ..... D21F 1/0036 139/383 R
8,480,857 B2 * 7/2013 Quigley ..... D21F 11/006 139/383 A
8,622,095 B2 * 1/2014 Quigley ..... D21F 11/006 139/383 A
8,808,506 B2 * 8/2014 Quigley ..... D21F 11/006 162/903
9,062,414 B2 * 6/2015 Chaplin ..... D21F 7/12
9,422,666 B2 * 8/2016 Patel ..... D03D 11/02
10,145,064 B2 * 12/2018 Despault ..... D21F 1/0036
10,344,432 B2 * 7/2019 Lamb ..... D21H 27/02
2004/0089363 A1 * 5/2004 Josef ..... D21F 1/0036 139/383 A
2012/0024489 A1 * 2/2012 Quigley ..... D21F 11/006 162/289

* cited by examiner

STRUCTURED FABRIC WITH DISCRETE ELEMENTS

FIELD AND BACKGROUND OF THE INVENTION

The invention concerns a woven fabric for use in a machine to produce a fiber web, preferably a tissue fiber web. The woven fabric has a machine direction and a cross machine direction, as well as a web facing side and a machine side. The web facing side is formed by MD yarns extending substantially in the machine direction of the woven fabric and by CD yarns extending substantially in the cross machine direction of the woven fabric, wherein the MD yarns and CD yarns are interwoven with each other, and wherein the woven fabric is adapted to structure the fiber web produced on the woven fabric.

Such fabrics, sometimes also called "structured fabrics" or "structuring fabrics" or "molding fabrics," are already known. For example, U.S. Pat. No. 7,879,193 B2 discloses such a fabric for producing a bulky web. The web facing side of that prior art fabric is characterized by a surface with raised lines surrounding a plurality of depressions known as pockets. During the fiber web formation process the fabric pockets allow discrete low-density "pillows" to be formed in the fiber web which are surrounded by a high-density fiber network. Especially in tissue production very high quality can be achieved by using a so-called "Through-Air-Drying" or TAD process for drying the low-density "pillows." The same is true for the so-called ATMOS process and the so-called E-TAD process. This fabric arrangement allows for the formation of tissue and towel with excellent softness, flexibility, absorbency, and strength properties.

However, with these woven fabrics having pockets on their web facing side, there is room for improvement in hand feel.

SUMMARY OF THE INVENTION

It is therefore an object of the present invention to further improve the known woven structured fabrics, especially in terms of hand feel of the fiber web produced thereon.

With the above and other objects in view there is provided, in accordance with the invention, a woven fabric for use in a machine for producing a fiber web, such a tissue web. The woven fabric having a machine direction, a cross machine direction, a web facing side, and a machine side, the woven fabric comprising:

- mutually interwoven machine direction (MD) yarns and cross direction (CD) yarns forming the web facing side with said MD yarns extending substantially in a machine direction of the woven fabric and said CD yarns extending substantially in a cross machine direction of the woven fabric;
- wherein the woven fabric is configured to structure the fiber web produced on the woven fabric;
- a plurality of adjacent long flotations of said MD yarns on the web facing side together forming a discrete element that is raised on the web facing side of the woven fabric for enabling the woven fabric to structure the fiber web, with long flotations being formed by an MD yarn passing over at least six adjacent CD yarns on the web facing side of the woven fabric.

In other words, the above objects are solved by the generic woven fabric as described at the beginning wherein a plurality of adjacent long flotations of MD yarns on the web facing side form together a discrete element that is raised on the web facing side of the woven fabric for allowing the woven fabric to structure the fiber web, wherein the term "long flotation" means that the MD yarn passes over at least six adjacent CD yarns on the web facing side of the woven fabric.

With a plurality of such discrete raised elements on the web facing side of the woven fabric according to the present invention, it is possible to change the fiber web produced thereon from having a plurality of discrete raised low-density areas surrounded by a network of high-density to having a plurality of discrete high-density areas surrounded by a raised low-density network. It is the merit of the inventor to have found out that such a change leads to a considerable improvement in hand feel while still providing excellent softness, flexibility, absorbency and strength properties to a tissue and towel product.

The term "extending substantially in the machine direction" and the term "extending substantially in the cross machine direction" mean that the corresponding MD yarns and CD yarns do not necessarily have to extend precisely in machine direction and cross machine direction, respectively, over their entire length. Local deviations are possible. For example, the yarns may meander to a certain extent. If the fabric is flat woven, the MD yarns usually correspond to the warp yarns while the CD yarns correspond to the weft yarns.

Although it is possible that the woven fabric according to the present invention is a multi-layer fabric, it is generally preferred—to keep the weaving process simple—that it is a single layer fabric. In this case, the MD yarns and CD yarns that form the web facing side of the woven fabric also form its machine side.

Forming the discrete element by a plurality of long flotations of MD yarns instead of long flotations of CD yarns has the advantage that with single layer fabrics the contact area of the woven fabric on the machine side can be primarily provided by CD yarns. With flat woven fabrics such fabrics are also called "weft runners." Weft runners are more wear-resistant because the CD yarns are usually subjected to lower tensile stress compared to the MD yarns in a web producing machine.

The term "discrete element" in the sense of the present invention means that such an element shall be completely surrounded by some kind of "valleys," i.e. portions that are not raised on the paper side of the fabric. Preferably, within such a valley there are no long flotations of MD yarns on the paper side. In other words, the MD yarns in the valley only form short flotations, i.e. they float over fewer than six adjacent CD yarns on the paper side.

In one preferred embodiment of the present invention each long flotation of the plurality of adjacent long flotations of MD yarns on the web facing side that form together the discrete element floats over at least eight adjacent CD yarns on the web facing side of the woven fabric.

Additionally or alternatively, each long flotation of the plurality of adjacent long flotations of MD yarns on the web facing side that form together the discrete element floats over not more than eleven adjacent CD yarns on the web facing side of the woven fabric.

More preferably, each long flotation of the plurality of adjacent long flotations of MD yarns on the web facing side that form together the discrete element floats over not more than nine adjacent CD yarns on the web facing side of the woven fabric.

For example, the length of all the long flotations can be 8 or 9.

In a particularly preferred embodiment of the present invention the discrete element is substantially diamond shaped. The term "substantially" in this context means that the shape does not have to be precisely a rhombus (rhomboid) in a geometric sense, i.e., a quadrilateral whose four sides all have the same length, wherein opposite angels have equal measure. However, the shape shall at least resemble a rhombus, hence the terms "substantially rhomboid" or "substantially diamond shaped."

The substantially diamond shaped discrete element may have a larger extension in machine direction compared to the cross machine direction of the woven fabric.

To impart a real structure into the fiber web that is produced on the woven fabric, it is preferred that the woven fabric comprises a plurality of such discrete elements on the web facing side of the woven fabric. All discrete elements may be formed the same way, thus, having substantially all the same aspect.

The discrete elements are preferably arranged in a regular pattern on the web facing side of the woven fabric. For example, the plurality of discrete elements can be arranged in columns extending in machine direction and in rows extending in cross machine direction wherein the discrete elements of a column may be offset in machine direction to the discrete elements of an adjacent column of discrete elements. The columns may not overlap each other in cross machine direction. In other words, each column is at least as wide in cross machine direction as the discrete elements in the column. Adjacent discrete elements in one row of discrete elements may have only a slight or even no offset relative to each other.

If the discrete elements of a column are offset in machine direction to the discrete elements of an adjacent column of discrete elements, the offset is preferably half the length of the discrete element that the discrete element has in machine direction. Thus, valleys can be formed between the discrete elements which valleys extend in straight lines that form an angle to the machine direction of the woven fabric. The term "angle" means in this context that the angle relative to the machine direction is greater than 0° and smaller than 90°, preferably between 10° and 30°.

Preferably, each long flotation of the plurality of adjacent long flotations of MD yarns on the web facing side that form together the discrete element overlap its adjacent long flotation by at least two CD yarns. In other words, two adjacent MD yarns can commonly float over at least two adjacent CD yarns.

In a preferred embodiment the discrete element is formed on the web facing side by long flotations of five adjacent MD yarns.

The CD yarns forming the web facing side of the woven fabric can have two different diameters wherein a first diameter is smaller than a second diameter. In that case, the CD yarns that pass over an MD yarn on the web facing side at a point where the long flotation of the MD yarn ends may have the first diameter, i.e. the smaller diameter. That means that the CD yarns to which this does not apply may have the second diameter, i.e. the larger diameter.

In one embodiment of the present invention the middle of the discrete element is free of long flotations. Thus, the discrete element may form a small pocket in its center, thereby being capable of further structuring the fiber web that is produced thereon. For example, if the discrete element is formed on the web facing side by long flotations of an odd number of adjacent MD yarns, the central MD yarn may form long flotations on the paper side only at the peaks of a substantially diamond shaped raised element but not in the middle. In the middle of the raised element, this central MD yarn may only form short flotations or even single knuckles on the paper side of the woven fabric.

Other features which are considered as characteristic for the invention are set forth in the appended claims.

Although the invention is illustrated and described herein as embodied in a structured fabric with discrete elements, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
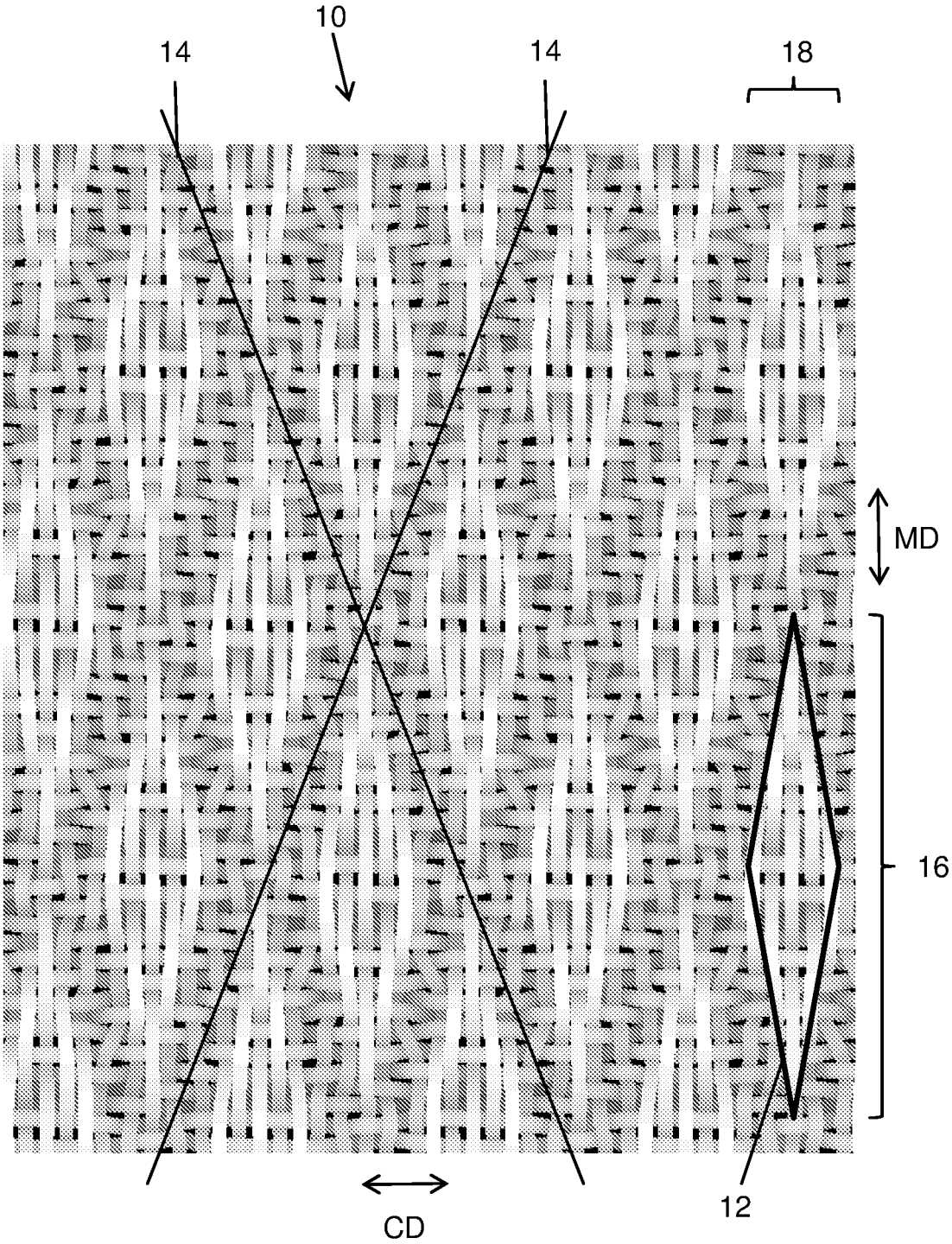
FIG. 1A shows a portion having a plurality of raised discrete elements on the paper side of a woven fabric according to a first embodiment of the present invention.

Referring now to the figures of the drawing in detail and first, in particular, to FIGS. 1A to 1D thereof, there is shown a first embodiment of the present invention. FIG. 1A shows a portion of the paper side of a woven fabric 10 according to the first embodiment of the present invention. As can be seen from this figure, a plurality of substantially diamond shaped raised discrete elements 12 is formed on the paper side of the woven fabric 10. Between these raised discrete elements 12 valleys 14 are formed. The valleys 14 extend in straight lines over the paper side of the woven fabric 10, wherein the straight lines form an angle between 0° and 90° with the machine direction MD and the straight lines of the valleys 14 intersect each other. In FIG. 1A, for the sake of simplicity, only one discrete element 12 is outlined and only the intersecting straight lines of two valleys 14 are emphasized. The raised elements 12 have substantially all the same aspect. Their extension in machine direction MD is larger than their extension in cross machine direction CD, preferably at least twice as large as their extension in cross machine direction CD.

Furthermore, the discrete elements 12 are arranged on the paper side of the woven fabric 10 in a substantially regular pattern. In this embodiment the discrete elements 12 are arranged in rows 16 that extend in cross machine direction CD and in columns 18 that extend in machine direction MD. The discrete elements 12 of one column 18 are arranged with an offset of about half the extension in machine direction MD of the discrete elements 12 with respect to the discrete elements 12 of an adjacent column 18. Thus, adjacent rows 16 overlap each other. In contrast to this, adjacent columns 18 do not overlap each other. The width of each column 18 substantially corresponds to the width of the discrete elements 12, i.e., to the extension of the discrete elements 12 in cross machine direction CD. Adjacent discrete elements 12 of one row 16 of discrete elements 12 have only a slight offset in machine direction MD relative to each other. This slight offset corresponds only to one CD yarn as may be best seen in the weaving card shown in FIG. 1C. The weaving card of FIG. 1C illustrates 20 MD yarns and 28 CD yarns. Whenever the number of an MD yarn is provided in the weaving card this means that the corresponding MD yarns floats at this particular position over the corresponding CD yarn on the paper side of the woven fabric 10.

Figure 1B:
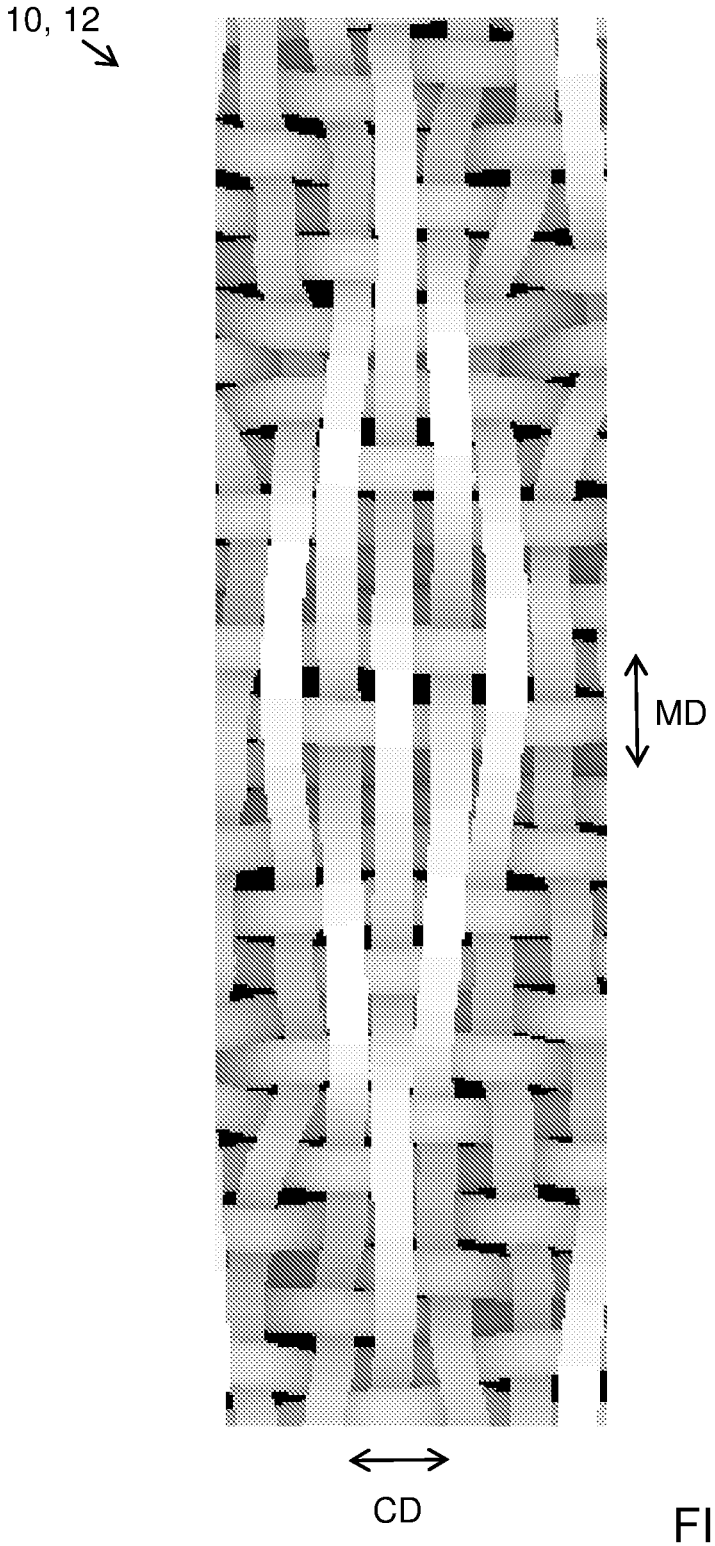
FIG. 1B shows an enlarged view of one raised discrete element from the first embodiment of FIG. 1A.
Figure 1C:
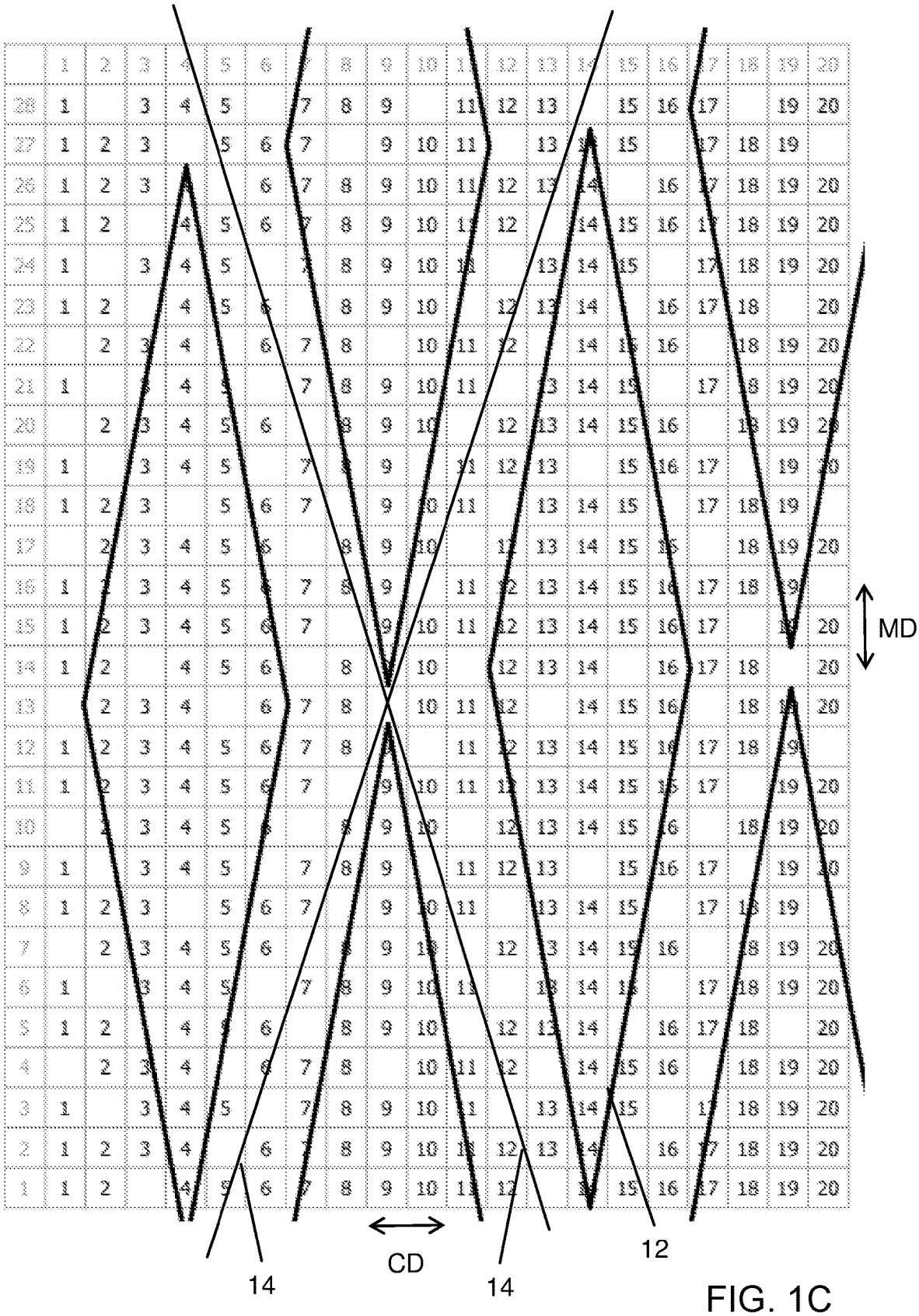
FIG. 1C shows a weaving card for the fabric shown in FIG. 1A, wherein several raised discrete elements are outlined.

FIG. 1B shows an enlarged view of one single discrete element 12 from FIG. 1A. As can be seen from this enlarged view, the discrete element 12 is formed by long flotations (that are highlighted in FIG. 1D) of five adjacent MD yarns that at least partially overlap each other in machine direction MD. The discrete element 12 of FIG. 1B may correspond to the discrete element 12 outlined in the weaving card of FIG. 1D. A first MD yarn, namely MD yarn number 12 according to the weaving card contributes to the discrete element 12 with only one long flotation passing over the CD yarns numbers 9-17 and thus having a length of nine. A second MD yarn, namely MD yarn number 13 contributes to the discrete element 12 with two long flotations passing over the CD yarns number 5-12 and 14-21, respectively, and thus each having a length of eight. A third MD yarn, namely MD yarn number 14 in this embodiment even contributes to the discrete element 12 with three long flotations passing over the CD yarns number 1-8, 10-18 and 20-27, respectively, thus having a length of eight, nine and eight, respectively. The third MD yarn is the central MD yarn of the discrete element 12. A fourth MD yarn, namely MD yarn number 15 contributes to the discrete element 12 with two long flotations passing over the CD yarns number 6-13 and 15-22, respectively, thus each having a length of eight. A fifth MD yarn, namely MD yarn number 16 contributes to the discrete element 12 with only one long flotation passing over the CD yarns number 9-17, thus having a length of nine. As may have been noticed, the discrete element is not fully symmetrical with respect to its central MD yarn (i.e., the third MD yarn with number 14) because the long flotations formed by the second MD yarn (i.e., the MD yarn having the number 13) are slightly offset in machine direction MD with respect to the flotations formed by the fourth MD yarn (i.e., the MD yarn having the number 15).

A second embodiment of the woven fabric 10 according to the present invention will be described in the following with reference to FIGS. 2A and 2B. These figures substantially correspond to FIGS. 1A and 1B of the first embodiment, respectively. In fact, both embodiments are very similar to each other, and the weaving card shown in FIGS. 1C and 1D also applies to the second embodiment of FIGS. 2A and 2B. The same reference signs have been chosen for both embodiments and in the following only the differences between these two embodiments will be discussed. For the rest, reference is made to the description of the first embodiment above.

The only difference between the second embodiment and the first embodiment is that in the second embodiment some CD yarns have a smaller diameter while the remaining CD yarns have a larger diameter. More precisely, the CD yarns that pass over an MD yarn on the web facing side at a point where the long flotation of the MD yarn ends have the smaller diameter. All other CD yarns to which this does not apply have the larger diameter. With respect to the weaving card shown in FIG. 1D, these particular points can be easily identified as blank fields at the corresponding ends of the highlighted flotations of the five MD yarns forming the discrete element 12. Thus, in this weaving card the CD yarns with numbers 4, 5, 9, 10, 13, 14, 18, 19, 22, 23 and 28 have the smaller diameter. Also the CD yarn with number 27 has the smaller diameter since the flotation of MD yarn with number 4 of another discrete element 12 ends there due to the above-mentioned slight offset (see FIG. 1C). As may have been noticed, the CD yarns with the smaller diameter always form pairs of adjacent CD yarns.

Figure 3A:
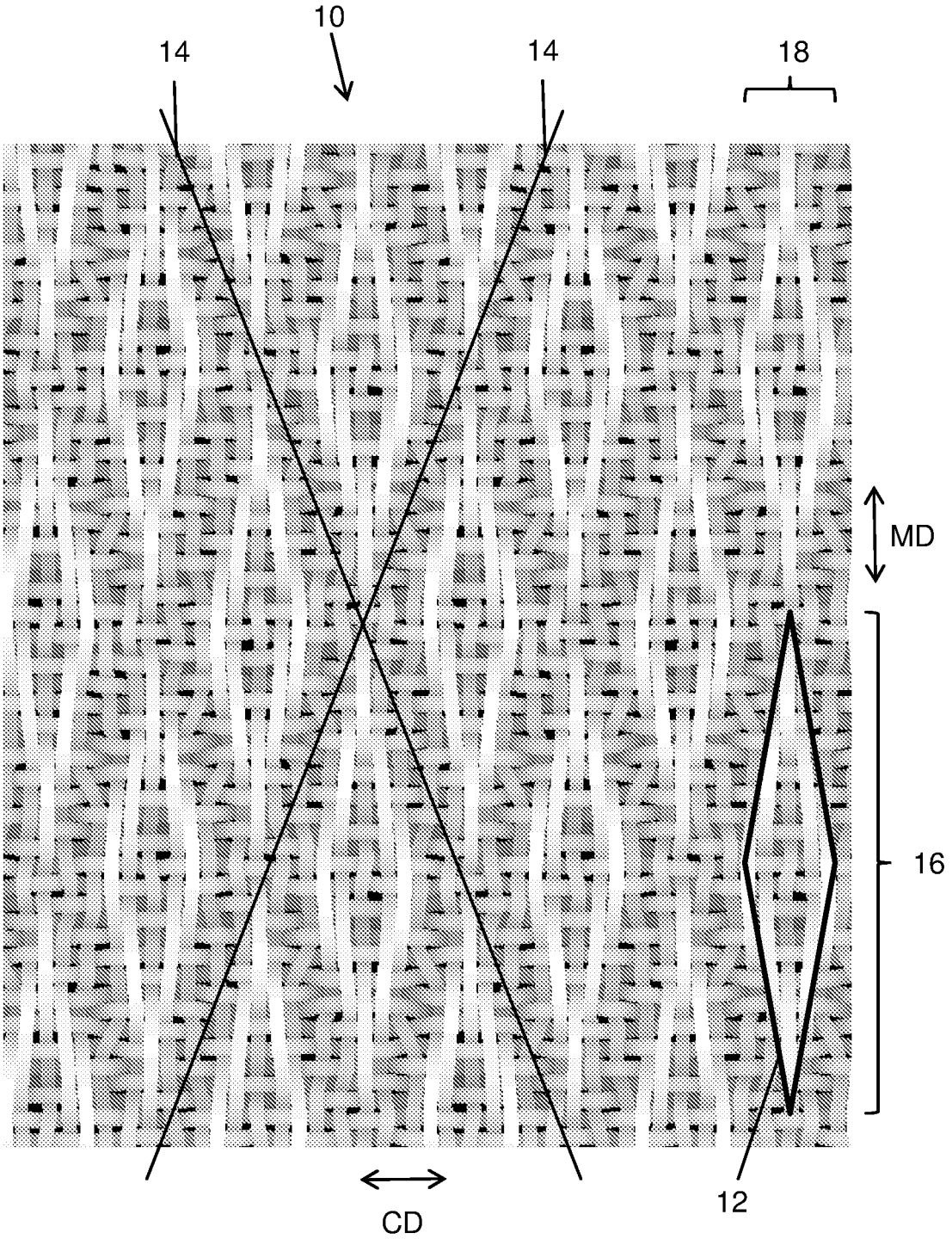
FIG. 3A shows a portion having a plurality of raised discrete elements on the paper side of a woven fabric according to a third embodiment of the present invention.
Figure 3B:
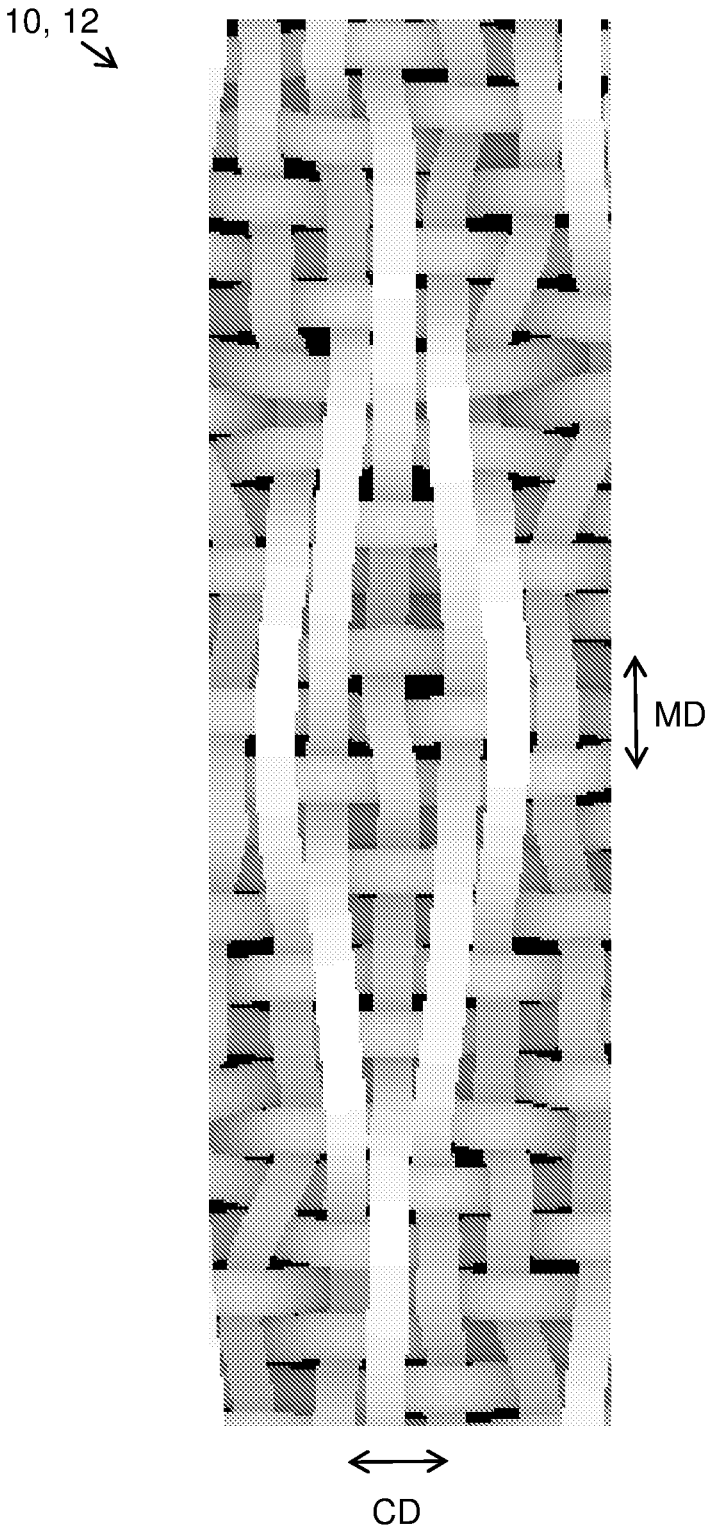
FIG. 3B shows an enlarged view of one raised discrete element from the third embodiment of FIG. 3A.

A third embodiment of the woven fabric 10 according to the present invention will be described in the following with reference to FIGS. 3A and 3B. These figures substantially correspond to FIGS. 1A and 1B of the first embodiment, respectively. In fact, both embodiments are similar to each other. Thus, the same reference signs have been chosen for both embodiments and in the following only the differences between these embodiments will be discussed. For the rest, reference is made to the description of the first embodiment above.

Figure 1D:
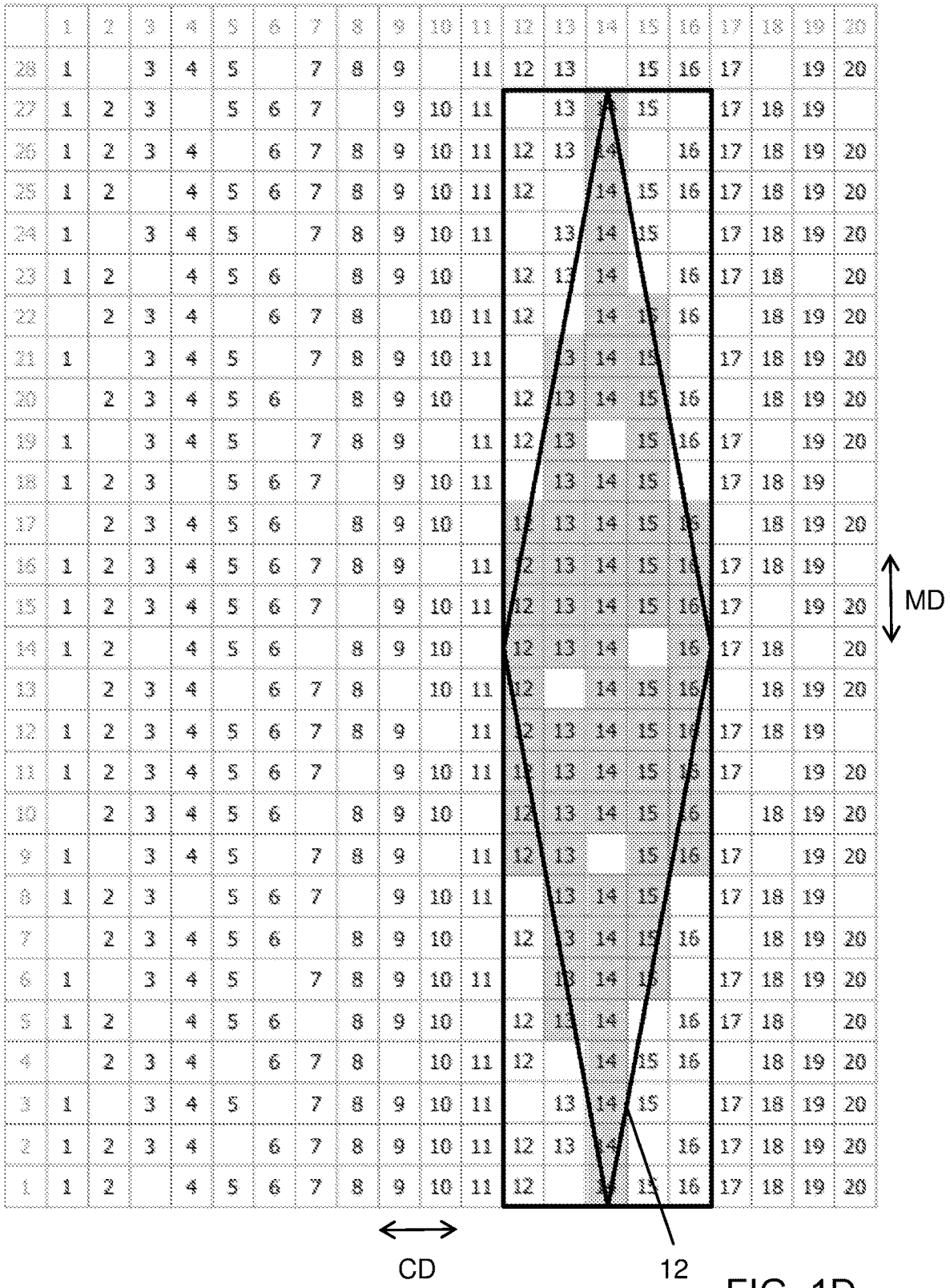
FIG. 1D shows the weaving card of FIG. 1C, wherein only one raised discrete element is outlined and the corresponding long flotations of MD yarns on the paper side are highlighted.
Figure 2A:
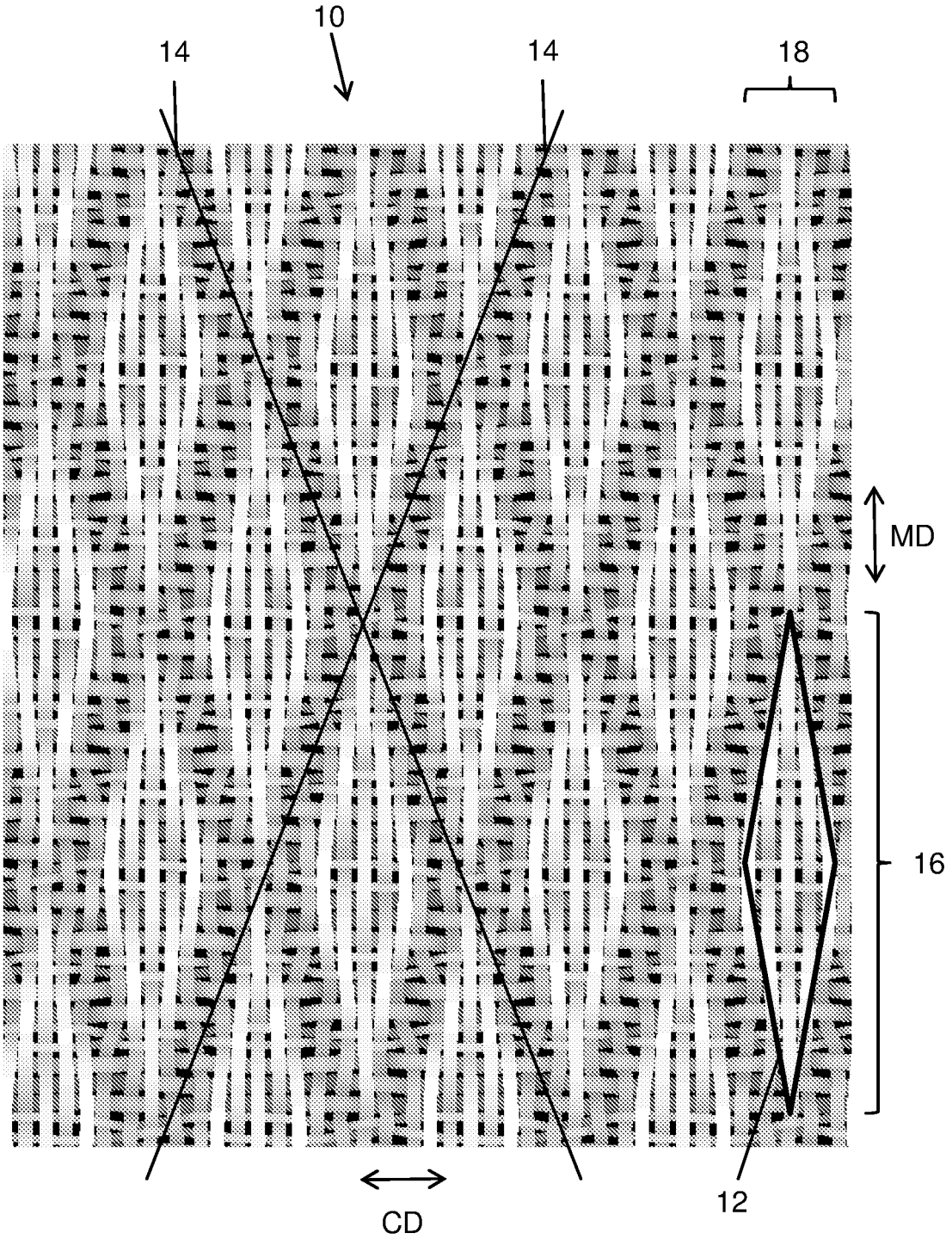
FIG. 2A shows a portion having a plurality of raised discrete elements on the paper side of a woven fabric according to a second embodiment of the present invention.
Figure 2B:
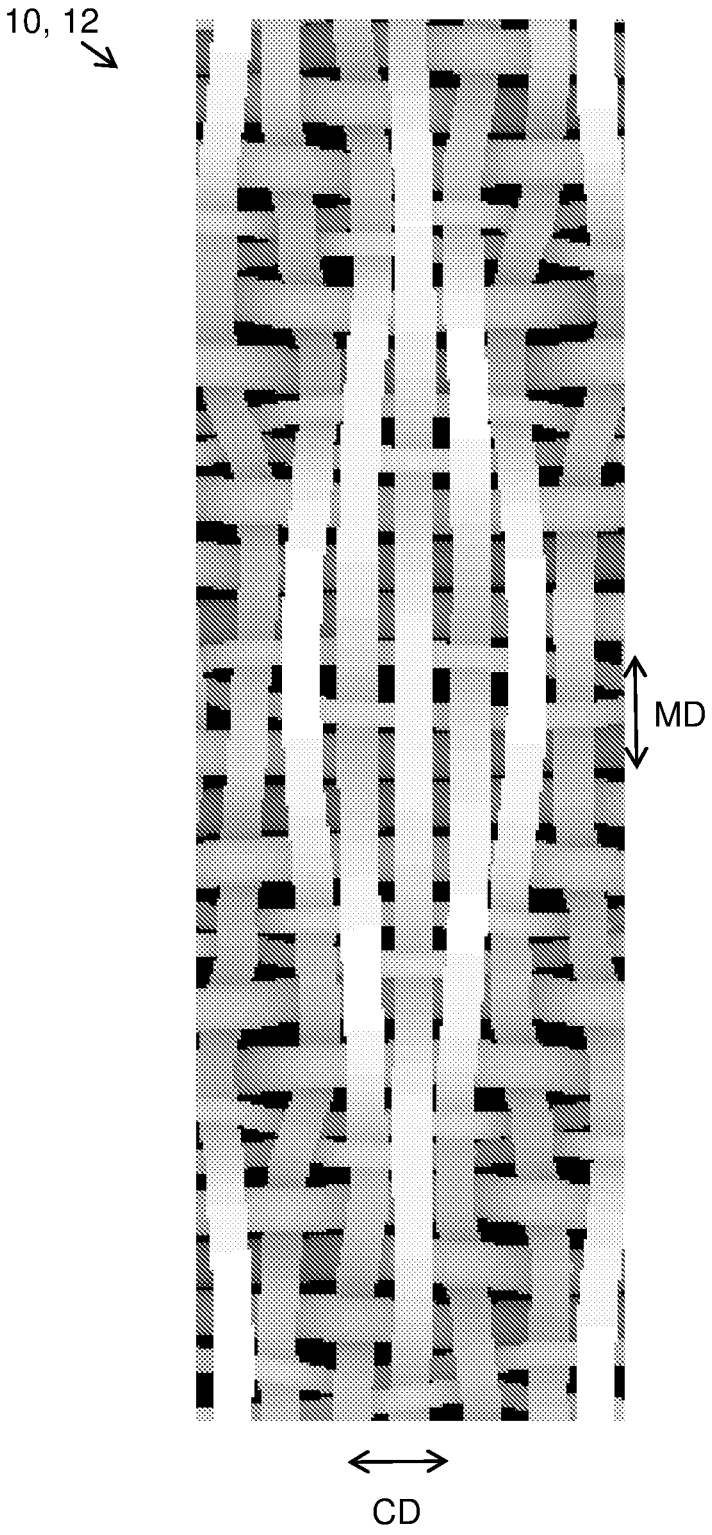
FIG. 2B shows an enlarged view of one raised discrete element from the second embodiment of FIG. 2A.

The only difference between the third embodiment and the first embodiment is that in the third embodiment the central MD yarn (i.e., the third MD yarn with number 14 according to the weaving card of FIG. 1D) only contributes to the discrete element 12 with two long flotations instead of three long flotations as in the first embodiment. These two long flotations pass over the CD yarns number 1-8 and 20-27, respectively, thus having each a length of eight. In the middle of the raised element 12, the central MD yarn only forms short flotations on the web facing side having the length of two or three. Thus, the middle of the discrete element 12 is free of a long flotation, so that the discrete element forms a small pocket in its center.

Figure 4A:
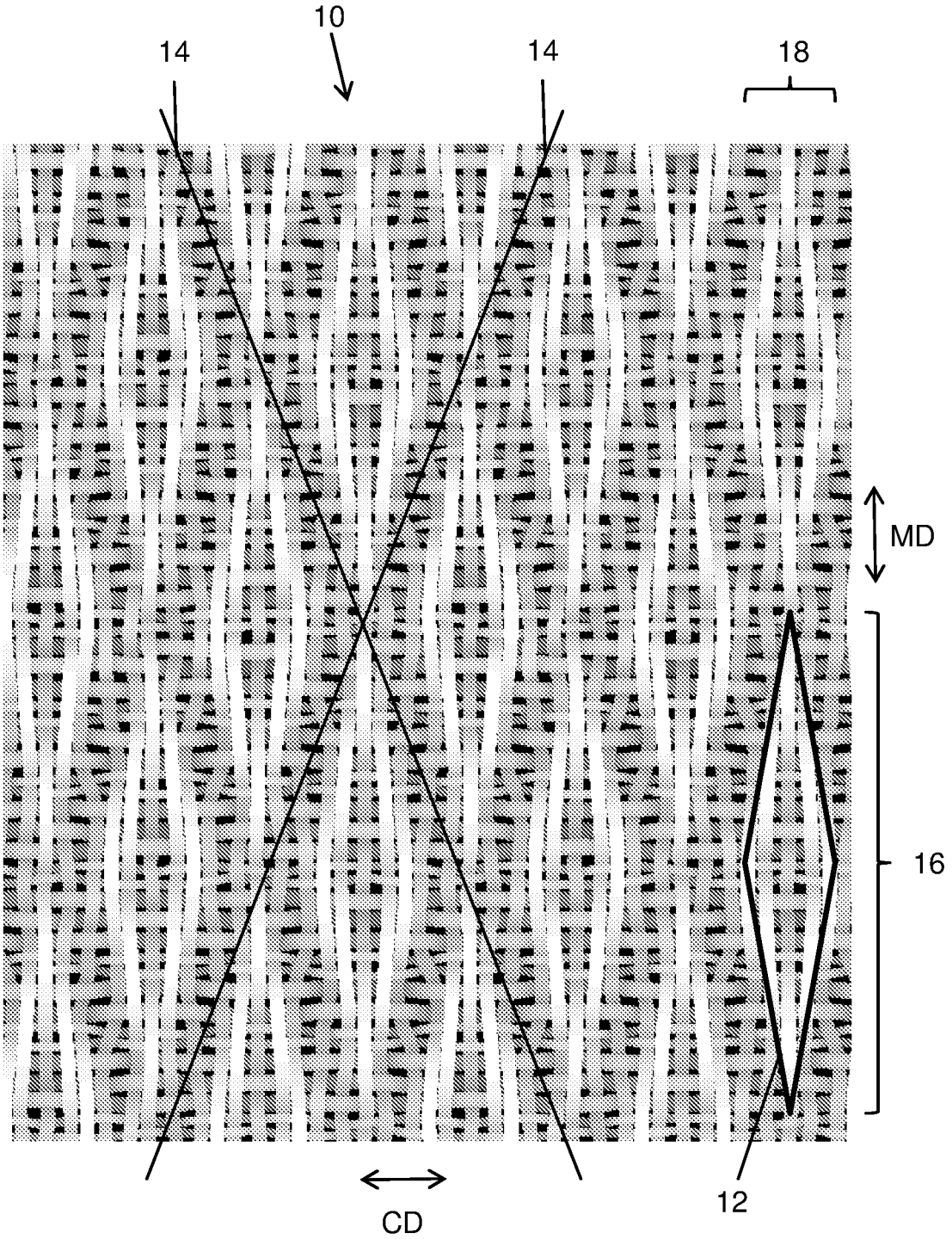
FIG. 4A shows a portion having a plurality of raised discrete elements on the paper side of a woven fabric according to a fourth embodiment of the present invention.
Figure 4B:
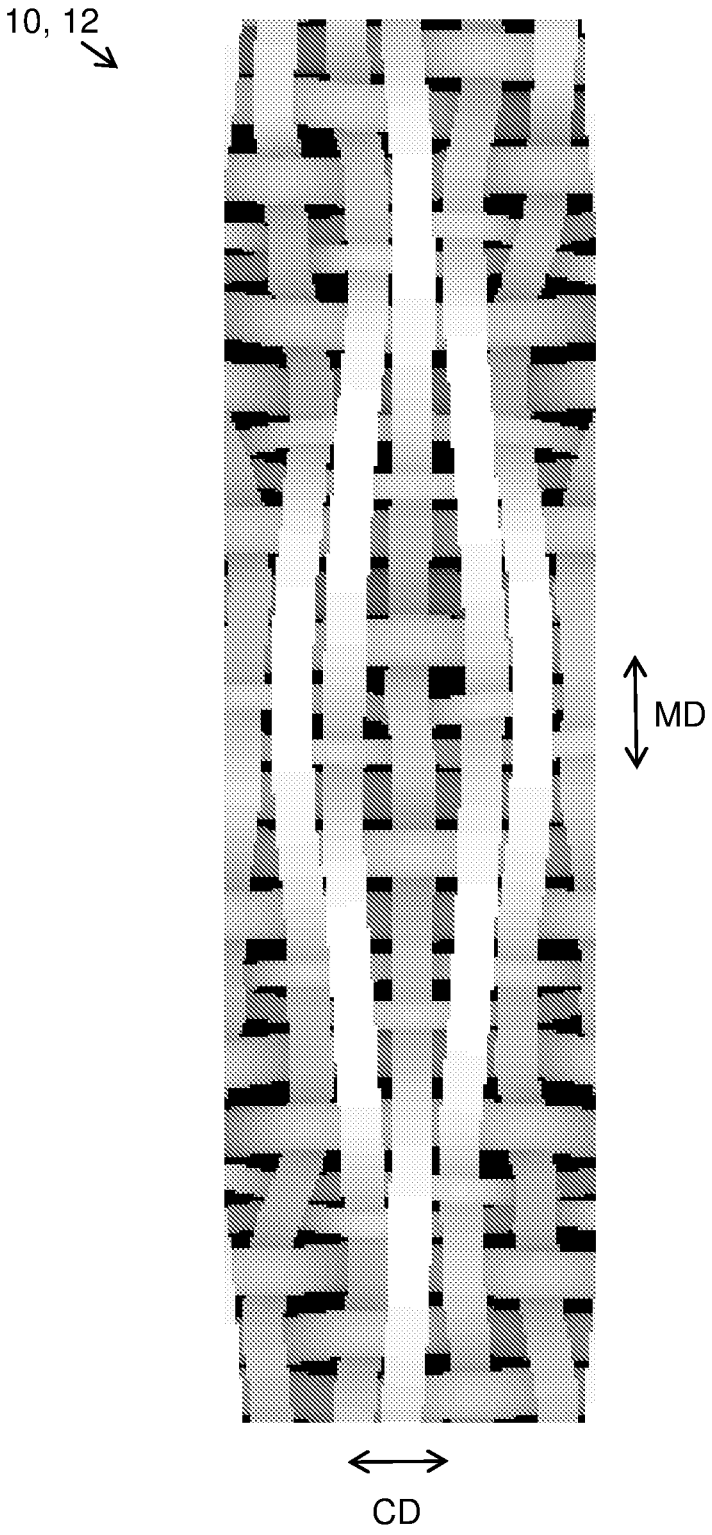
FIG. 4B shows an enlarged view of one raised discrete element from the fourth embodiment of FIG. 4A.

A fourth embodiment of the woven fabric 10 according to the present invention is shown in FIGS. 4A and 4B. These figures substantially correspond to FIGS. 2A and 2B of the second embodiment, respectively, as well as to FIGS. 3A and 3B of the third embodiment, respectively. In fact, the fourth embodiment represents a mixture of the second and the third embodiment. It comprises the CD yarns of smaller diameter according to the second embodiment and the central MD yarn only contributes to the discrete element 12 with two long flotations according to the third embodiment. To avoid redundancies, reference is made to the description of the second and third embodiments above.

The following is a summary list of reference numerals and the corresponding structure used in the above description of the invention:

10 woven fabric
12 discrete element
14 valley
16 row (of discrete elements)
18 column (of discrete elements)

MD machine direction

CD cross machine direction

The invention claimed is:

1. A woven fabric for use in a machine for producing a fiber web, the woven fabric having a machine direction, a cross machine direction, a web facing side, and a machine side, the woven fabric comprising:

mutually interwoven machine direction (MD) yarns and cross direction (CD) yarns forming the web facing side with said MD yarns extending substantially in a machine direction of the woven fabric and said CD yarns extending substantially in a cross machine direction of the woven fabric;

wherein the woven fabric is configured to structure the fiber web produced on the woven fabric;

a plurality of more than two mutually adjacent long flotations of mutually adjacent said MD yarns on the web facing side together forming a discrete element that is raised on the web facing side of the woven fabric for enabling the woven fabric to structure the fiber web, with long flotations being formed by an MD yarn passing over at least six mutually adjacent CD yarns on the web facing side of the woven fabric.

2. The woven fabric according to claim 1, wherein the fiber web is a tissue fiber web.

3. The woven fabric according to claim 1, wherein each long flotation of said plurality of more than two adjacent long flotations of MD yarns on the web facing side that together form the discrete element floats over at least eight adjacent CD yarns on the web facing side of the woven fabric.

4. The woven fabric according to claim 1, wherein each long flotation of said plurality of more than two adjacent long flotations of MD yarns on the web facing side that together form the discrete element floats over not more than eleven adjacent CD yarns on the web facing side of the woven fabric.

5. The woven fabric according to claim 1, wherein each long flotation of said plurality of more than two adjacent long flotations of MD yarns on the web facing side that together form the discrete element floats over not more than nine adjacent CD yarns on the web facing side of the woven fabric.

6. The woven fabric according to claim 1, wherein the discrete element is substantially diamond shaped.

7. The woven fabric according to claim 6, wherein the substantially diamond shaped discrete element has a larger extension in machine direction compared to the cross machine direction of the woven fabric.

8. The woven fabric according to claim 1, wherein the discrete element is one of a plurality of discrete elements on the web facing side of the woven fabric.

9. The woven fabric according to claim 8, wherein said plurality of discrete elements are arranged in a regular pattern on the web facing side of the woven fabric.

10. The woven fabric according to claim 8, wherein said plurality of discrete elements are arranged in columns extending in the machine direction and in rows extending in the cross machine direction, and wherein the discrete elements of a column are offset in machine direction to the discrete elements of an adjacent column of discrete elements.

11. The woven fabric according to claim 10, wherein the offset is one half a length of said discrete element in the machine direction, thus forming valleys between said discrete elements which valleys extend in straight lines that form an angle to the machine direction of the woven fabric.

12. The woven fabric according to claim 1, wherein each long flotation of said plurality of more than two adjacent long flotations of MD yarns on the web facing side that together form the discrete element overlap a respectively adjacent long flotation by at least two CD yarns.

13. The woven fabric according to claim 1, wherein said discrete element is formed on the web facing side by long flotations of five adjacent MD yarns.

14. The woven fabric according to claim 1, wherein said CD yarns forming the web facing side of the woven fabric have two different diameters, with a first diameter being smaller than a second diameter.

15. The woven fabric according to claim 14, wherein said CD yarns that pass over an MD yarn on the web facing side at a point where the long flotation of said MD yarn ends has the first diameter.

16. The woven fabric according to claim 1, wherein a middle of said discrete element is free of long flotations.

17. The woven fabric according to claim 1, wherein said mutually adjacent long flotations are offset from one another in the machine direction by an offset of two or more mutually adjacent CD yarns.

* * * * *